US009867429B2

(12) United States Patent
Hastings

(10) Patent No.: US 9,867,429 B2
(45) Date of Patent: Jan. 16, 2018

(54) SHOELACE CINCHING APPARATUS AND ASSOCIATED METHODS

(71) Applicant: Steve K Hastings, Winston-Salem, NC (US)

(72) Inventor: Steve K Hastings, Winston-Salem, NC (US)

( * ) Notice: Subject to any disclaimer, the term of this patent is extended or adjusted under 35 U.S.C. 154(b) by 245 days.

(21) Appl. No.: 14/795,864

(22) Filed: Jul. 9, 2015

(65) Prior Publication Data

US 2017/0006970 A1 Jan. 12, 2017

(51) Int. Cl.
*A43C 1/06* (2006.01)
*A43C 7/00* (2006.01)

(52) U.S. Cl.
CPC ..... *A43C 1/06* (2013.01); *A43C 7/005* (2013.01)

(58) Field of Classification Search
CPC ..... A43C 1/06; A43C 7/005; Y10T 24/3705; Y10T 24/3713; Y10T 24/3973; Y10T 24/3969
See application file for complete search history.

(56) References Cited

U.S. PATENT DOCUMENTS

| | | | | |
|---|---|---|---|---|
| 819,884 | A * | 5/1906 | Higgins | A43C 7/04 24/712.2 |
| 5,345,656 | A * | 9/1994 | Merritt | F16G 11/14 24/115 H |
| 6,871,423 | B2 * | 3/2005 | King, Jr. | A43B 3/0031 24/712.9 |
| 9,468,262 | B2 * | 10/2016 | Caron | A43C 7/005 |
| 2004/0172796 | A1 * | 9/2004 | King, Jr. | A43B 3/0031 24/712.5 |
| 2004/0172850 | A1 * | 9/2004 | King, Jr. | A43B 3/0031 36/50.1 |

* cited by examiner

*Primary Examiner* — Robert Sandy
*Assistant Examiner* — Louis A Mercado
(74) *Attorney, Agent, or Firm* — Ben Schroeder Law, PLLC

(57) ABSTRACT

An apparatus that allows laces, ropes, and/or string to be cinched. In an embodiment, an apparatus that contains two parts, one part (e.g., the second part) is designed to accommodate the passage through it of the laces, ropes, and/or strings and the other part (e.g., the first part) is designed to releasably join with the second part allowing the laces, ropes, and/or strings to be cinched.

16 Claims, 7 Drawing Sheets

SHOELACE CINCHING APPARATUS AND ASSOCIATED METHODS

FIELD OF INVENTION

This invention relates to the adjustment and preservation of the tension of a shoelace, and more particularly, an apparatus for quickly and easily adjusting the tension of a shoelace threaded through a shoe without the need for tying and untying knots.

BACKGROUND OF THE INVENTION

Shoelaces have been used since before 3000 BCE. A shoelace is typically threaded through a plurality of eyelets on opposing sides of an expansion opening of a shoe. The lace elements are pulled until a desired tension is achieved between the shoe and the foot of the wearer. Traditionally, the tension is preserved by tying the ends of the shoe laces in a knot. The process of tightening and tying the lacing, elements on shoes requires time, knowledge, and physical dexterity. Moreover, the use of a knot alone to tie a shoelace often causes the tension of the lace to relax prematurely, resulting in a poor fit of the shoe upon the wearer. Another problem with this method of fastening a shoe lace is that it often becomes untied with movement of the wearer. An unfastened shoe lace is a trip hazard for the shoe wearer.

The process of tying a shoelace is a challenge for many of those who have handicaps that are physical or mental. These groups are most at risk for injury if as shoelace becomes untied prematurely. The untying and tying of the shoelace may also take too much time in time-sensitive situations like races or other sporting events. The present invention solves these problems by providing a shoelace adjustment and fastening device which users can operate with less attention, less dexterity, and less time than is necessary for tying a shoelace. The present invention also reduces the risks associated with an unintended reduction of tension in the shoelace.

A variety of devices have been invented for locking shoelaces, and laces in general, without requiring the tying thereof. Many of these devices are overly complicated. Though they provide an easy means to fasten the lace, they require a high threshold level of attention and dexterity to adjust the tension of the lace. The locking devices contain grips that impair the movement, of the shoe lace along the device such that adjustment of the tension of the lace becomes unduly difficult.

Many of these devices are operated such that the user is likely to accidentally relax the tension of the lace more than desired. Such devices require that the ends of the lace are pulled in opposite directions to maintain some tension while adjusting the device to alter the tension of the shoelace. This requires moving three elements in differing directions: the two ends of the shoelace in opposite directions from each other, and the device winch moves in a direction nearly perpendicular to the direction of the shoelaces. This controlled manipulation of three elements along three different vectors is difficult to maintain when the user has the use of only two hands. In this situation, the user is likely to release at least one end of the lace to free a band to adjust the device. Doing so results in a loss of control of the tension during adjustment.

Some previous devices use a clasp mechanism to lock a lace. For example, in U.S. Pat. No. 6,871,423 to King, Jr., (which is incorporated by reference in its entirety), the clasp in these devices includes a receptacle for the ends of the lace that is connected to a cover by pivotation to bring the cover into closing engagement over the receptacle, and to open the clasp to provide access to the receptacle. The angle at which the hinge opens is not limited, and in use the cover pivots 180 degrees about the hinge. Unrestricted and frequent rotation of the covers around the hinges wears on the hinge mechanisms and makes it more likely that the covers will fall off these devices.

It is with these deficiencies in mind that the instant invention was designed.

SUMMARY OF THE INVENTION

The present invention is an apparatus for adjusting and locking the tension of a threaded lace. Different embodiments are described herein, but all allow for the movement of the apparatus along ends of as lace to adjust the tension of the stretched shoelace.

In one embodiment, the present invention relates to as lace cinching apparatus which users can operate with less attention, less dexterity, and less time than is necessary for tying a shoelace with the devices of the prior art or without a device at all. In as variation, the present invention also relates to reducing risks associated with the unintended reduction of tension in the shoelace relative to shoes that do not contain the device.

In one embodiment, the present invention solves the problem of unintentional detachment of an element of an apparatus by fitting the two components of the apparatus using a snap-fit locking mechanism to secure the shoelace that releasably joins the two components.

In one embodiment, the two parts may be made of two molded plastic components. Releasing the locking mechanism is easily done by one hand and does not damage or deform the apparatus. The locking mechanism may be repeatedly secured and released without reducing the retention performance of the lock.

In one embodiment, when the first component is fully engaged with the second component, the lateral movement of the lacing elements through the second component is prevented by cinching the lacing elements between the first and second components. When the first component is fully engaged (e.g. in a closed position) with the second component the shoelace is fastened and locked, and the tension of the shoelace is preserved.

The method of using the apparatus comprises causing the apparatus to come into a configuration that enables the adjustment of the tension of the lace.

DETAILED DESCRIPTION

The present invention relates to an apparatus that allows shoelaces to be cinched so that they cannot be easily untied. In an embodiment, the apparatus of the present invention comprises two components, a first component and a second component that can be realeasbly joined together so that they have at least two states, a partially open state and a closed state, and when they are in the closed state, the first component and second component when fully engulfed act to cinch the shoelace so that it cannot be easily untied.

The invention will now be described with reference to the figures. This description is meant to be non-limiting so that modifications can be made without departing from the spirit and scope of the invention.

Figure 1:
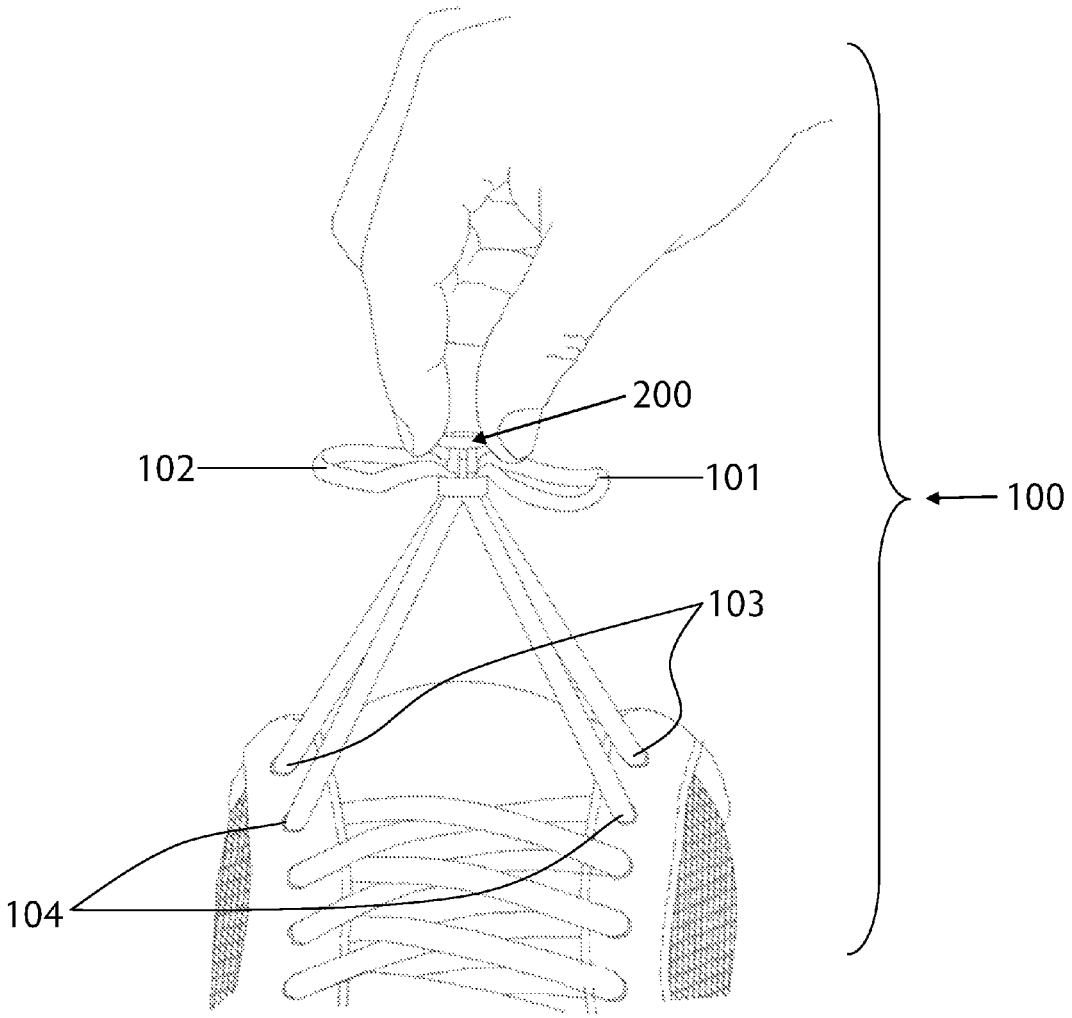
FIG. 1 depicts a perspective view of the lace-cinching apparatus with the two components partially open with a shoe in the act of adjusting the lace.
Figure 2:
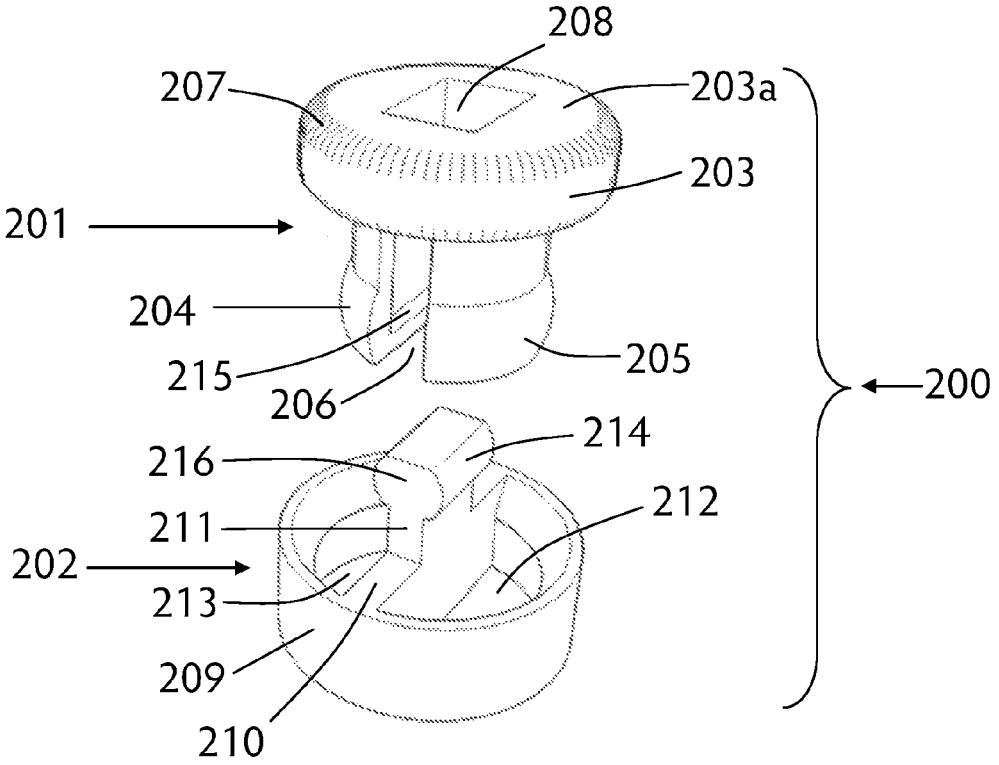
FIG. 2 depicts a perspective view of the lace-cinching apparatus with the two components in an unjoined state.

FIG. 1 depicts a perspective view of the lace-cinching apparatus 200 with two components, a first component 201 and a second component 202 (the first component 201 and second component 202 are better seen in FIG. 2) unjoined with a shoe (collectively 100). The laces 101, 102 pass through the apparatus 200, and particularly the second component 202 wherein the laces 101, 102 then are cinched by the joining of the first component 201 and second component 202 together into a closed state. In one embodiment, lace 101, 102 is configured so that it passes through terminal eyelets 103 and penultimate eyelets 104.

FIG. 2 illustrates the apparatus 200 with first component 201 and second component 202 in their unjoined state. First component 201 has a head 203 and a first arm 204 and a second arm 205, the first arm 204 and second arm 205 being connected to the head 203, but positioned in a direction that is substantially perpendicular to the head 203. In an embodiment, the first arm 204 and the second arm 205 are positioned so that a gap 206 is present between the first arm 204 and second arm 205. In an embodiment, the head may also possess grip structure 207 positioned circumferentially around the head 203. In a variation, the head may also contain a hole 208 that is substantially perpendicular to the head top surface 203*a*. In an embodiment, the hole 208 continues to the gap 206.

Second component 202 comprises a circular base 209 and a bisecting bar 210. The bisecting bar 210 bisects the circular base 209 so as to form a first aperture 213 and a second aperture 212. The bisecting bar 210 has a rigid protrusion 211 that emanates in a perpendicular direction from the bisecting bar 210. At the end of rigid protrusion 211 is knob 214.

First component 201 and second component 202 are designed so that they can be joined together. First arm 204 and second arm 205 are designed to respectively fit into and be accommodated by first aperture 213 and second aperture 212. The rigid protrusion 211 is designed to fit into and be accommodated by the gap 206 and the hole 208 in the first component 201. Accordingly, when the first component 201 and the second component 202 are releasably joined together, the first component 201 and the second component 202 can in one embodiment be joined so that knob 214 protrudes from, or in an alternate embodiment, lies flush with the top surface 203*a* of head 203 through hole 208. In one embodiment, the bottom surface of the head (i.e., the flat surface that is on the head on the side adjacent to the first arm 204 and second arm 205—this cannot be seen in FIG. 2) can abut the top of circular base 209 so as to cinch a lace that goes through first aperture 213 and second aperture 212 (better seen in FIG. 4). In one embodiment, knob 214 can be designed with a flat top (as shown in FIG. 2) so that it sits flush with the top surface 203*a* of head 203. In one embodiment, first component 201 may also possess a ridge 215, which is designed to prevent knob 214 and correspondingly second component 202 from easily being removed from first component 201. That is, gap 206 is slightly smaller than width 216 of knob 214 meaning that rigid protrusion 211 and knob 214 can only be inserted into gap 206 by applying sufficient pressure so as to allow flex in first arm 204 and/or second arm 205 thereby allowing the joinder of the first component 201 and the second component 202. When first component 201 and second component 202 are joined in this manner and knob 214 is adjacent to ridge 215, the apparatus 200 is in a partially open state. By continuing to apply downward force on top surface 203*a* of head 203 the knob 214 will move away from ridge 215 towards hole 208. In one variation, there may be features present in first component 201 that allows knob 214 to snap fit into first component 201 (not shown in the figures). Alternatively (for example, as shown in FIG. 7), there may be features present in both first component 201 and second component 202 that allow the two components when in the closed state to be further joined by a snap fit.

Figure 3:
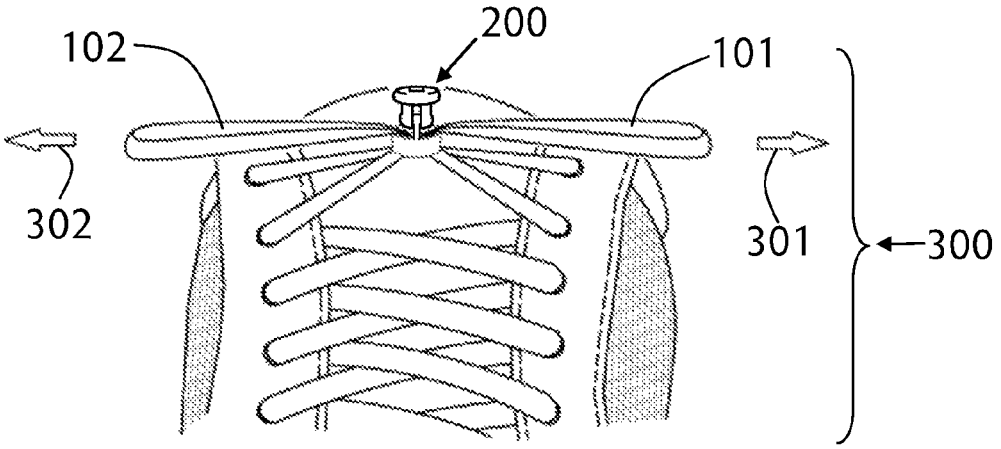
FIG. 3 shows a perspective view of the lace-cinching apparatus in a partially open state in conjunction with proper tension in the laces, just before the closed state.
Figure 4:
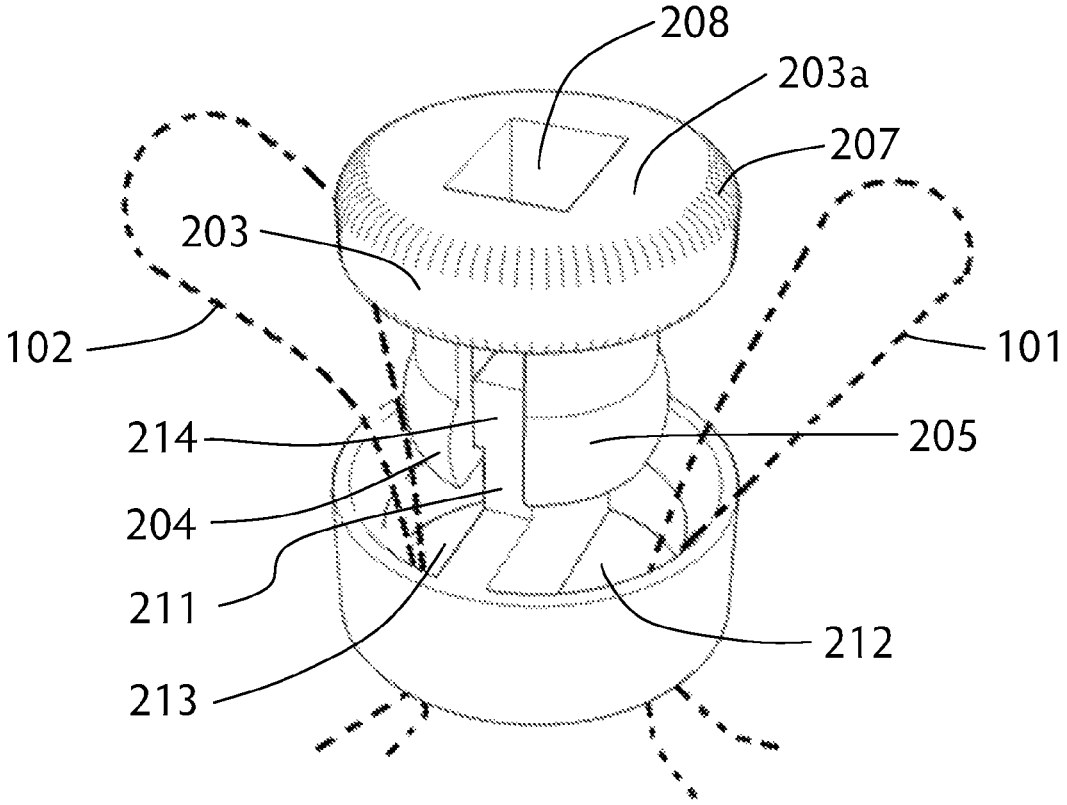
FIG. 4 shows a perspective close-up view of the lace-cinching apparatus in a partially open state with the laces shown as they pass through the apparatus.

FIG. 3 shows apparatus 200 in a partially open state with laces 101 and 102 passing through the second component 202. By pulling laces in the direction of arrows 301, 302 the lace can be adjusted in its passage through the second component 202 so that the laces 101, 102 are tight in the shoe. FIG. 4 illustrates a perspective view of the apparatus 200 in the partially open state. Laces 101, 102 pass through first aperture 213 and second aperture 212 of second component 202. Rigid projection 211 and knob 214 are present in gap 206 (not numbered). By applying a downward pressure on top surface 203*a* of head 203, the apparatus 200 will go from the partially open state seen in FIG. 4 to a closed state.

Figure 5:
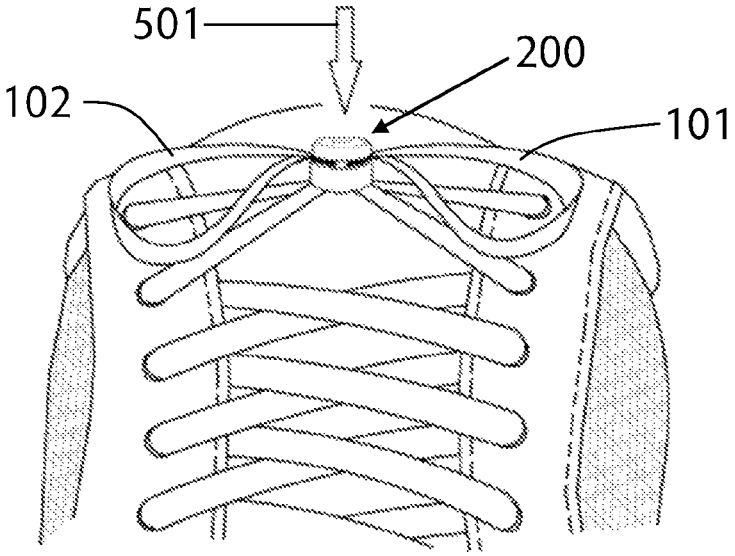
FIG. 5 shows a perspective view of the lace-cinching apparatus in the closed state in conjunction with a shoe with laces cinched.
Figure 6:
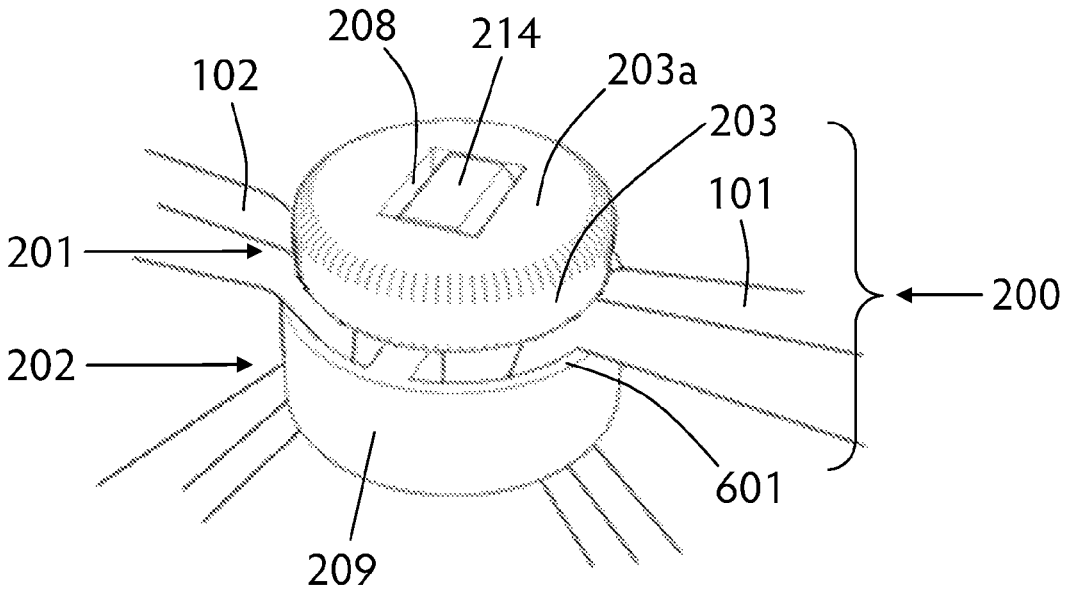
FIG. 6 shows a perspective view of the lace-cinching apparatus in the closed state with the laces cinched.

FIG. 5 shows a front perspective view of the apparatus 200 in the closed state. Having applied downwardly pressure as shown by arrow 501 cinches the laces 101, 102 between first component 201 and second component 202. FIG. 6 shows apparatus 200 in a state that is in the closed state. Laces 101 and 102 are cinched between first component 201 and second component 202. In one embodiment, the top edge 601 of second component 202 applies the cinching of laces 101 and 102 when it is in close proximity to the bottom of first component 201. Knob 214 can be seen in hole 208 with the top part of knob 214 almost substantially flush with the top surface 203 of head 203. In one variation, when knob 214 is in the closed state, there may be inner parts that allow knob 214 to snap fit in place so that it can not be easily removed.

Figure 7:
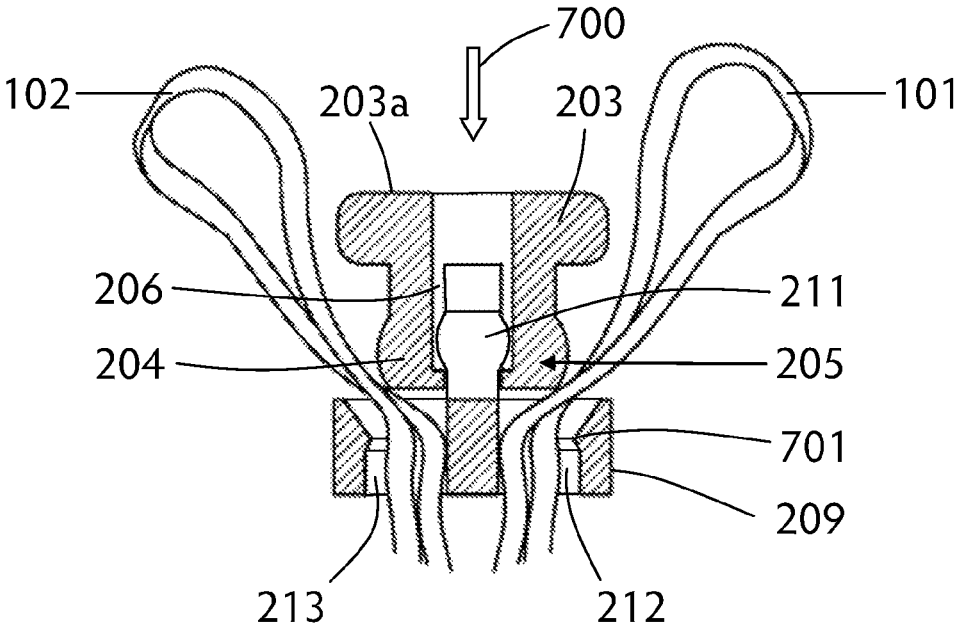
FIG. 7 shows a cross-sectional view of the lace-cinching apparatus with laces incorporated into the apparatus.

FIG. 7 shows a cross sectional view of the apparatus 200 in a partially open state with laces 102 and 101 passing through first aperture 213 and second aperture 212, respectively. Rigid protrusion 211 can be seen entering gap 206 between first arm 204 and second arm 205. Moreover, if downwardly pressure as shown by au-row 700 is placed upon the top surface 203*a* of head 203, first arm 204 and second arm 205 will continue to be pushed into first aperture 213 and second aperture 212, respectively. In one embodiment, the lengths and shapes of first arm 204 and second arm 205 are designed so as to snap fit in place when the apparatus 200 attains the closed position. The inner surface 701 of circular base 209 of second component 202 may also be comprised of a shape (as shown here) that when the downwardly pressure as shown by arrow 700 is applied, first arm 204 and second arm 205 with their rounded profiles may be pushed in an inwardly direction that allows the combination of inner surface 701, the first arm 204 and the second arm 205 to snap fit into place (e.g., attain the closed position). The closed position will result in laces 101 and 102 being cinched in place.

When the apparatus 200 is in a closed state, pulling up on the head 203 in a direction that is opposite the direction of arrow 700 will result in the apparatus going back into a partially open state and swill allow the laces 101 and 102 to become uncinched. The partially open state allows the laces to be adjusted wherein the closed state cinches the laces. For example, in the partially open state, the laces can be tightened more with only too hands and the apparatus can again be made to go into the closed, cinched state, thereby providing a more taut lace on the shoe.

Figure 8:
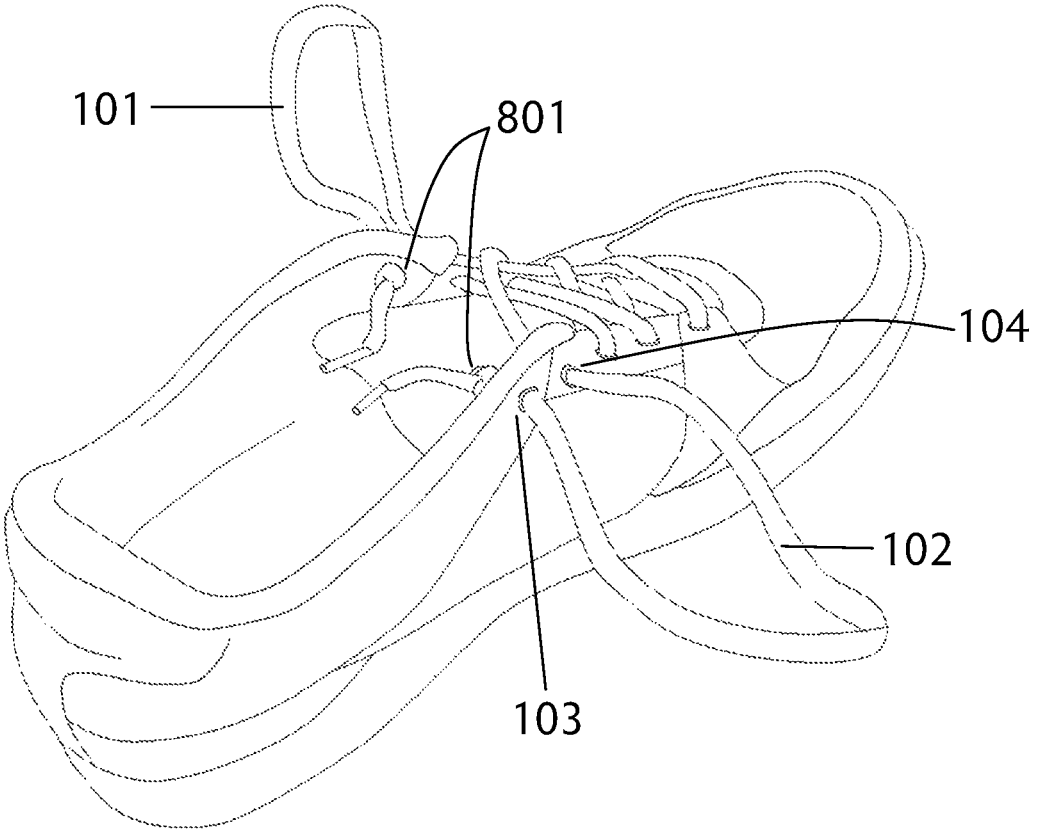
FIG. 8 shows a perspective view of a shoe that has the laces tied in a way that allows the apparatus to be used.

FIG. 8 shows an embodiment of a shoe that can be used with the apparatus (200—not shown in FIG. 8). In this embodiment, lace 102 passes through from the inside of terminal penultimate eyelet 104 and then from the outside of the shoe through terminal eyelet 103. A knot 801 can be used to maintain this configuration of the laces 101 and 102 through the shoe. By employing this configuration, one does not need to tie the typical shoelace knot but rather laces 101 and 102 can be passed through the second component 202 as shown in, for example, FIG. 4.

Figure 9A:
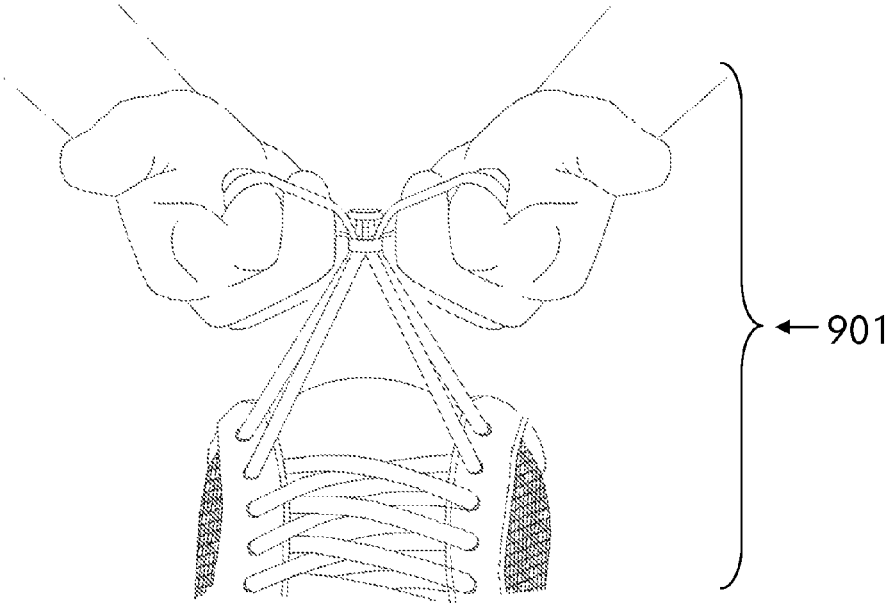
FIGS. 9A and B show two stages of the lace being incorporated into the apparatus with the lace transitioning from a looser state (9A) to a state in which the lace is more tightened (9B) with the lace maintaining its tension.
Figure 9B:
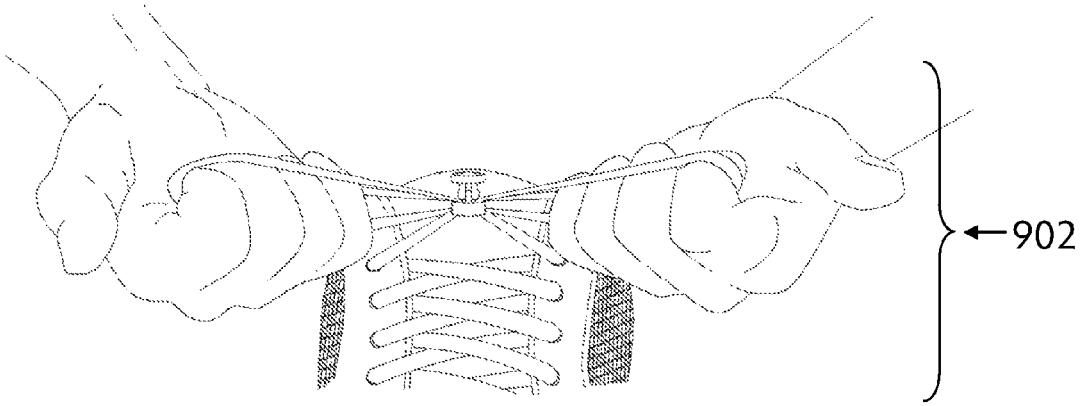
Figure 10A:
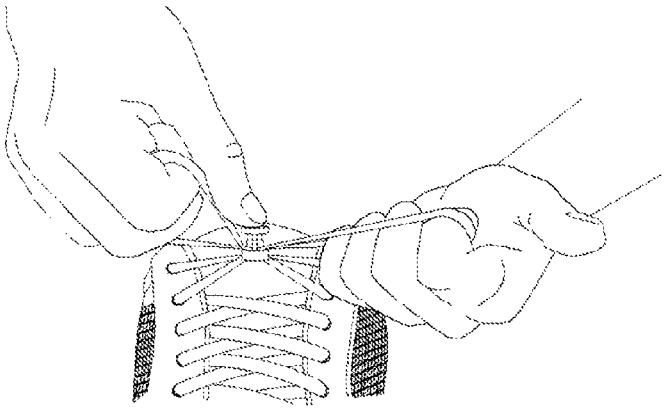
FIGS. 10A, B, and C show two different perspective views of the apparatus being pushed into the closed state (FIGS. 10A and 10B) and a perspective view of a shoe with the apparatus in the closed state (FIG. 10C).
Figure 10B:
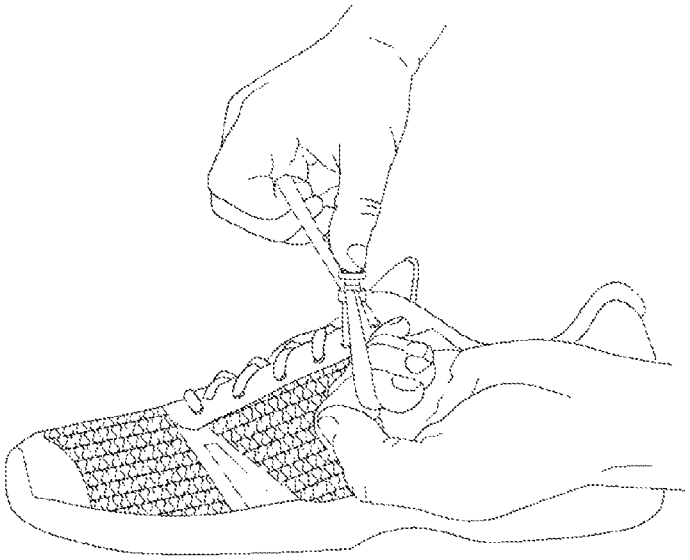
Figure 10C:
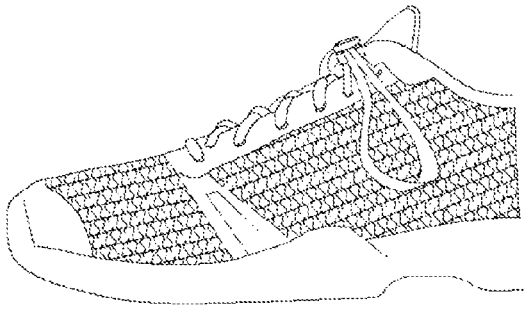

FIGS. 9A and 9B show perspective views of a person tightening the shoelace with FIG. 9A representing the shoelace in a slightly less taut configuration 901 and FIG. 9B representing the shoelace in a more taut configuration 902. FIGS. 10A and 10B show a person depressing the top surface 203*a* of bead 203 allowing the apparatus 200 to transition into the closed position. It should be noted that the apparatus can be pushed into the closed position rather easily with the use of only two hands. Other shoelace tightening devices of the prior art do not possess this ease of use. Finally, FIG. 10C shows a side view of a shoe with the apparatus 200 in the closed position thereby cinching the laces.

With the figures described, it should be apparent that minor modifications can be made without departing from the spirit and scope of the present invention.

In an embodiment, the present invention relates to a lace-cinching apparatus comprising: a first component that is releasably joined to a second component.

said first component comprising a head, it first arm and a second arm, said head defined by a top surface and a bottom surface, said bottom surface continuous with and perpendicular to both the first arm and the second arm, each of the first arm and the second arm defined as having an interior side, an exterior side, a proximal end, and a distal end, with a gap that is defined by space that exists between the first arm and second arm;

wherein said second component comprises a circular base, a bisecting bar and a rigid protrusion, said bisecting bar is connected to and bisects said circular base providing for a first aperture and a second aperture on respective sides of the bisecting bar, said rigid protrusion being continuous with, attached to, and perpendicular to said bisecting bar;

wherein the gap in the first component is designed to accommodate the rigid protrusion of the second component, allowing the rigid protrusion to enter into and fit within the gap, and the first arm and the second arm of the first component are designed to fit into the first aperture and the second aperture, respectively of the second component, thereby allowing a lace to be cinched between the first component and the second component.

In a variation, when the first component is joined with the second component, the lace cinching apparatus comprises at least two states, a partially open state and a closed state, the partially open state allowing the lace to be moveable and/or adjustable, and the closed state allowing the lace to be cinched between the first component and the second component.

In a variation, the first arm and the second arm and the rigid protrusion are comprised of a resilient material. In one variation, the resilient material comprises polypropylene.

In an embodiment, when the first component and the second component are joined, they may be joined by snap-fit engagement. Accordingly, the structural elements necessary to undergo a means of a snap fit engagement may be present on the first component and/or second component.

In one variation, the head of the first component may further comprise a hole that extends from the top surface to the bottom suffice of the head in a direction that is parallel with the first arm and second arm and perpendicular to the top surface. In one variation, the hole is designed to accommodate the rigid protrusion when in the closed state.

In one variation, the head may be substantially cylindrical in shape. In a variation, the head may comprise a grip structure, wherein the grip structure is designed to allow a hand to grip and manipulate the bead of the first component. In a variation, the grip structure may facilitate a user to transition from the partially open state to the closed state. In a variation, the grip structure provides a rough surface that allows a user to use frictional force to manipulate the head.

In an embodiment, the present invention relates to a lace-cinching apparatus comprising a first component and a second component, the first component comprising, to first arm, a second arm and a gap, the second component comprising a rigid protrusion and a first aperture and a second aperture, the first component designed and accommodated to releasably join with the second component, wherein when the first component and second component are joined, the first arm fits in the first aperture, the second arm fits in the second aperture, and the rigid protrusion fits in the gap.

In one variation, when the first component and second component are joined, the lace-cinching apparatus comprises at least two states, a partially open state that allows a user to adjust a lace, and a closed state that cinches the lace. In a variation, the closed state may also comprise a snap fit. In a variation, the closed state may be attained by applying downward pressure on the first component towards the second component.

In one embodiment, the apparatus is made of a hard plastic selected from the group consisting of polypropylene, phenol/formaldehyde polymer, is polyvinylchloride polymer, a polycarbonate polymer, a butadiene styrene copolymer, a polycarbonate butadiene styrene copolymer, a polyetherether ketone polymer, a polyarylether ketone polymer, and a clay nanosheet-containing water soluble polymer, or combinations thereof.

In one variation, the lace-cinching apparatus is made by injection molding.

In an embodiment, the present invention relates to methods of using the apparatus. In one variation, the invention relates to a method of cinching a shoe lace, said method comprising cinching a shoelace on a shoe by using the lace-cinching apparatus as described above.

In one variation, the method allows a user to cinch a shoelace by attaining the closed state of the lace-cinching apparatus.

In one embodiment, the present invention relates to as kit that comprises the shoe-lacing apparatus described herein. In one variation, the kit may optionally contain one or more of a shoelace or metal rings that fit into shoe eyelets. In one variation, the kit comprises a shoelace.

In one embodiment, the device of the present invention can be made of plastic, such as a hard plastic. It is contemplated that plastics that may be used in the present invention include polypropylene, or other polymer such as phenol/formaldehyde polymer, a polyvinylchloride polymer, a polycarbonate polymer, a butadiene styrene copolymer, as polycarbonate butadiene styrene copolymer, a polyetherether ketone polymer, a polyarylether ketone polymer, or a clay nanosheet-containing water soluble polymer, or combinations thereof the apparatus of the invention can be made by injection molding or by other means known to those of skill in the art.

It should be understood that other materials may be used to manufacture the apparatus of the present invention such as metals, woods, or hard rubbers.

In an embodiment, the present invention may be offered as is part of a kit wherein one or a plurality of the apparati of the present invention may be included with other things such as laces, and/or metal rings to fit in shoe eyelets.

In an embodiment, the invention relates to various methods of using the apparatus of the present invention. For example, methods that can be accomplished by using the apparatus of the present invention include a method of preventing and/or reducing the incidence of tripping, a method of reducing the incidence of injury, a method of cinching shoelaces, a method of allowing a physically disabled person to easily cinch shoelaces, a method of reducing the time it takes to put on shoes and cinch the shoelaces, or other methods.

Although the figures are shown with respect to a shoe and the tightening of shoelaces, it is contemplated and therefore within the scope of the invention that other potential uses can be attained by using the apparatus of the present invention. For example, it is contemplated that the apparatus or a similar apparatus can be used with the cords on curtains, or potentially a bigger apparatus can be used that allows one to cinch strings and/or ropes (this might have potential use with nautical uses such as docking boats, or in the transport of goods such as tying goods to the roofs of cars, or other similar events that might use string and/or ropes).

It should be understood that the present invention is not to be limited by the above description. Modifications can be made to the above without departing from the spirit and scope of the invention. It is contemplated and therefore within the scope of the present invention that any feature that is described above can be combined with any other feature that is described above (even if those features are not described together). Moreover, it should be understood that the present invention contemplates and it is therefore within the scope of the invention that any element that is described can be omitted from the apparatus and/or methods of the present invention. In any event, the scope of protection to be afforded is to be determined by the claims which follow and the breadth of interpretation which the law allows.

What is claimed is:

1. A lace-cinching apparatus comprising:

a first component that is releasably joined to a second component, said first component comprising a head, a first arm and a second arm, said head defined by a top surface and a bottom surface, said bottom surface continuous with and perpendicular to both the first arm and the second arm, each of the first arm and the second arm defined as having an interior side, an exterior side, a proximal end, and a distal end, with a gap that is defined by space that exists between the first arm and the second arm;

wherein said second component comprises a circular base, a bisecting bar and a rigid protrusion, said bisecting bar is connected to and bisects said circular base providing for a first aperture and a second aperture on respective sides of the bisecting bar, said rigid protrusion being continuous with, attached to, and perpendicular to said bisecting bar;

wherein the gap in the first component is designed to accommodate the rigid protrusion of the second component, allowing the rigid protrusion to enter into and fit within the gap, and the first arm and the second arm of the first component are designed to fit into the first aperture and the second aperture, respectively of the second component, thereby allowing a lace to be cinched between the first component and the second component, wherein when the first component is joined with the second component, the lace-cinching apparatus comprises at least two states, a partially open state and a closed state, the partially open state allowing the lace to be moveable in the first aperture and the second aperture, and the closed state allowing the lace to be cinched between the first component and the second component, wherein the head of the first component further comprises a hole that extends from the top surface to the bottom surface in a direction that is parallel with the first arm and the second arm, wherein the hole is designed to accommodate the rigid protrusion when in the closed state.

2. The lace-cinching apparatus of claim 1, wherein said first arm and said second arm and said rigid protrusion are comprised of a resilient material.

3. The lace-cinching apparatus of claim 2, wherein the resilient material comprises polypropylene.

4. The lace-cinching apparatus of claim 2, wherein the first component and the second component are joined by snap-fit engagement.

5. The lace-cinching apparatus of claim 1, wherein said head is substantially cylindrical in shape.

6. The lace-cinching apparatus of claim 1, wherein the head has a grip structure, said grip structure designed to allow a hand to grip and manipulate the head of the first component.

7. The lace-cinching apparatus of claim 6, wherein the grip structure facilitates transition from the partially open state to the closed state.

8. The lace-cinching apparatus of claim 1, wherein the lace-cinching apparatus is made by injection molding.

9. A kit comprising the lace-cinching apparatus of claim 1 and optionally one or more of a shoelace or metal rings that fit into shoe eyelets.

10. The kit of claim 9, wherein the kit comprises the shoelace.

11. A lace-cinching apparatus comprising a first component and a second component, the first component comprising a first arm, a second arm and a gap, the second component comprising a rigid protrusion and a first aperture and a second aperture, the first component designed and accommodated to releasably join with the second component, wherein when the first component and the second component are joined, the first arm fits in the first aperture, the second arm fits in the second aperture, and the rigid protrusion fits in the gap, wherein when the first component is joined with the second component, the lace-cinching apparatus comprises at least two states, a partially open state and a closed state, the partially open state allowing a lace to be moveable in the first aperture and the second aperture, and the closed state allowing the lace to be cinched between the first component and the second component, wherein a head of the first component further comprises a hole that extends from a top surface to a bottom surface in a direction that is parallel with the first arm and the second arm, wherein the hole is designed to accommodate the rigid protrusion when in the closed state.

12. The lace-cinching apparatus of claim 11, wherein the closed state also comprises a snap fit.

13. The lace-cinching apparatus of claim 11, wherein the closed state is attained by applying downward pressure on the first component towards the second component.

14. The lace-cinching apparatus of claim 11, wherein the apparatus is made of a hard plastic selected from the group consisting of polypropylene, phenol/formaldehyde polymer, a polyvinylchloride polymer, a polycarbonate polymer, a butadiene styrene copolymer, a polycarbonate butadiene styrene copolymer, a polyetherether ketone polymer, a polyarylether ketone polymer, and a clay nanosheet-containing water soluble polymer, or combinations thereof.

15. A method of cinching the shoelace, said method comprising cinching a shoelace on a shoe by using the lace-cinching apparatus of claim 11.

16. The method of claim 15, wherein said method cinches the shoelace by attaining the closed state of the lace-cinching apparatus.

* * * * *